US006729146B2

(12) United States Patent
Lucatello

(10) Patent No.: US 6,729,146 B2
(45) Date of Patent: May 4, 2004

(54) METHOD AND APPARATUS FOR STORING TOBACCO-BASED PRODUCTS AND PACKED BEVERAGES AT THE SAME TIME

(75) Inventor: Luciano Lucatello, Treviso (IT)

(73) Assignee: Società Vetraria Biancadese Sas, Biancade (IT)

( * ) Notice: Subject to any disclaimer, the term of this patent is extended or adjusted under 35 U.S.C. 154(b) by 0 days.

(21) Appl. No.: 10/221,327

(22) PCT Filed: Jan. 9, 2002

(86) PCT No.: PCT/EP02/00130

§ 371 (c)(1),
(2), (4) Date: Sep. 11, 2002

(87) PCT Pub. No.: WO02/055945

PCT Pub. Date: Jul. 18, 2002

(65) Prior Publication Data

US 2003/0031777 A1 Feb. 13, 2003

(30) Foreign Application Priority Data

Jan. 11, 2001 (IT) ..... TV2001A0003

(51) Int. Cl.[7] ..... F25D 17/06; C12C 1/00
(52) U.S. Cl. ..... 62/91; 62/459.7; 426/590
(58) Field of Search ..... 62/3.6, 459.7, 62/91, 3.3, 252, 249; 426/590

(56) References Cited

U.S. PATENT DOCUMENTS 2,245,234 A 6/1941 Tanner
2,561,276 A * 7/1951 Hill ..... 62/419
5,848,534 A 12/1998 Stauffer

FOREIGN PATENT DOCUMENTS

| | | |
|---|---|---|
| DE | 665708 | 1/1952 |
| WO | 99/66272 A1 | 12/1999 |
| WO | 01/69145 A1 | 9/2001 |

* cited by examiner

*Primary Examiner*—Chen Wen Jiang
(74) *Attorney, Agent, or Firm*—Birch, Stewart, Kolasch & Birch, LLP

(57) ABSTRACT

The invention provides for the private use of an apparatus to cool down bottled and similarly packed beverages (further to other food products, if desired) and, at the same time, to keep at optimum temperature and relative humidity values tobacco products, in particular cagars. To this purpose, use is made in a cabinet (110) of a column (F1) of ascending air which, after undergoing refrigeration through a functional cooling unit (50) arranged in the lowest compartment (10), flows first through an intermediate compartment (120) holding the beverages, and then through the uppermost compartment (140) in w3hich the tobacco products are stored. Upon transfering its humidity over to said tobacco products, the air then flows back to the refrigerating unit (50) along a countercurrent flow (F3) with respect to the ascending column (F1).

13 Claims, 3 Drawing Sheets

METHOD AND APPARATUS FOR STORING TOBACCO-BASED PRODUCTS AND PACKED BEVERAGES AT THE SAME TIME

This application is the national phase under 35 U.S.C. §371 of PCT International Application No. PCT/EP02/00130 which has an International filing date of Jan. 9, 2002, which designated the United States of America.

DESCRIPTION

1. Field of the Invention

The present invention refers to a method and an apparatus for preserving cigars (as well as other tobacco-based products) and bottled or similarly packed beverages at the same time, which is intended for private use, ie. for use not only in a private home or dwelling, including a hotel room, but also in restricted-access premises, admittance to which is restricted to persons of known identity and/or bound by statutory ties, such as for instance a club of cigar smoking persons.

2. Description of Related Art

The optimum storage conditions for tobacco-based products required to ideally preserve the characteristics that are the most appreciated and valued ones by the consumers, starting from the scent thereof, are largely known to impose accurately controlled values of both temperature and relative humidity. On the other hand, there is currently no knowledge of the existence or availability of functional apparatuses, and not simple containers, which are adapted to ensure such optimum storage conditions even throughout longer periods of time. Known is on the contrary the existence of refrigerating apparatuses for bottled or canned beverages, which are commonly known as mini-bars and are traditionally not very much cared of under either the functional aspect or the aesthetical one.

It therefore is a main purpose of the present invention to provide an apparatus in which there is generated a forced flow of air that is kept at the desired conditions of temperature and relative humidity in view of being able to store in a first compartment beverages held in a sealed container (such as in particular wine in bottles), or possibly even other fresh food products, cooled down at temperatures that are lower than the ambient temperature, but anyway higher than 0° C., and tobacco-based products in a subsequent compartment, communicating with said first one, at a correct value of relative humidity to preserve their characteristics.

BRIEF SUMMARY OF THE INVENTION

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The description that is given below by way of non-limiting example, refers to the accompanying drawings, which are given by way of illustration only, and thus are not limitative of the present invention, and in which.

DETAILED DESCRIPTION OF THE INVENTION

Figure 1:
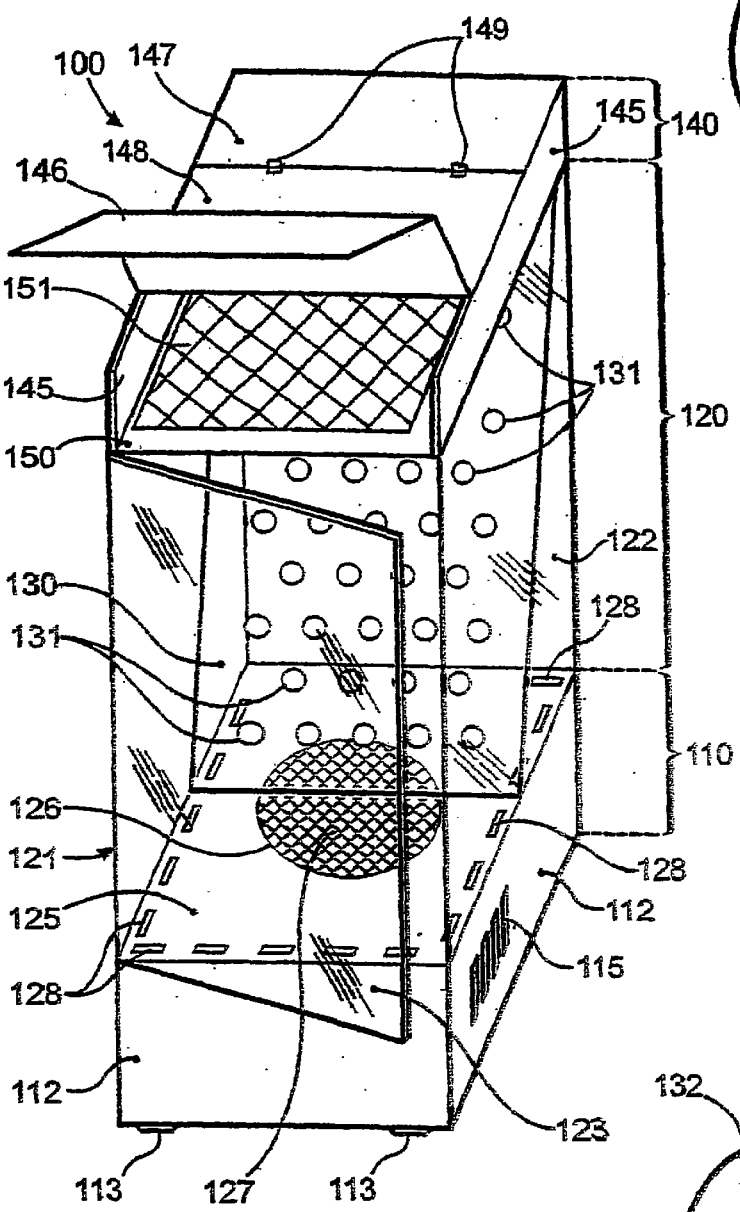
FIG. 1 is a see-through overall view of an apparatus according to the present invention.
Figure 3:
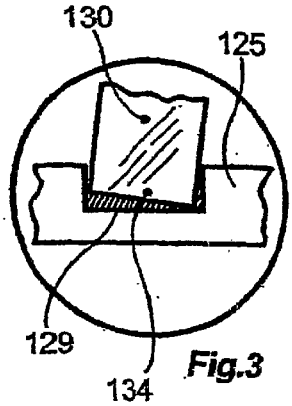
FIG. 3 is an enlarged view of the detail enclosed in the circle X in FIG. 2.
Figure 4:
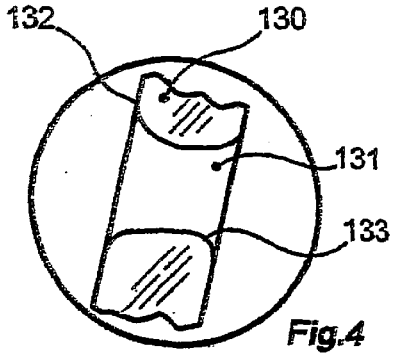
FIG. 4 is an enlarged view of the detail enclosed in the circle Y in FIG. 2.
Figure 2:
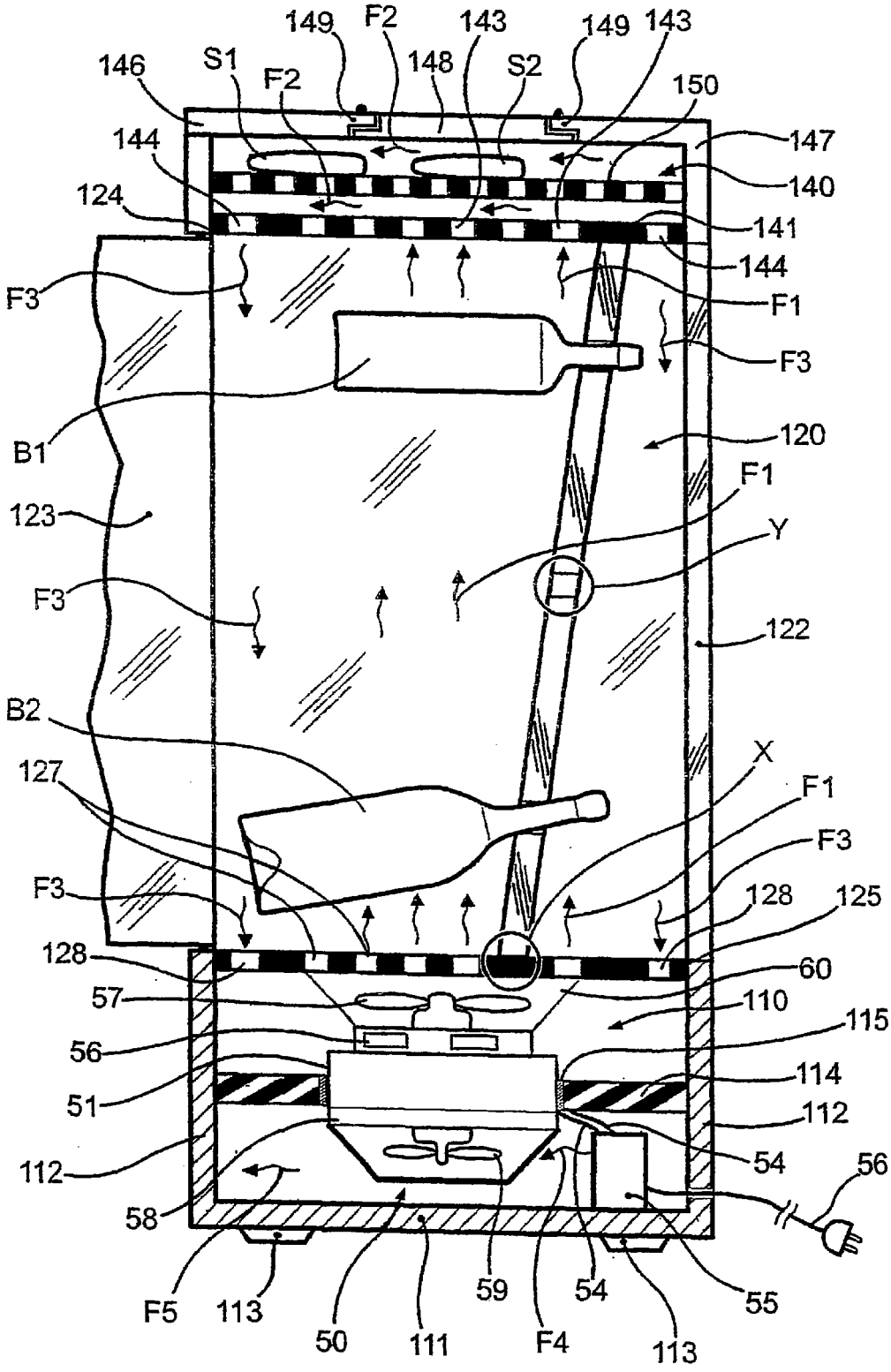
FIG. 2 is a vertical-section view of the apparatus illustrated in FIG. 1.

With reference to FIGS. 1 to 4, an apparatus according to the present invention consists substantially of a parallelepiped-shaped outer cabinet 100, which is subdivided, from the bottom upwards, into three compartments, ie.:

a lower compartment 110, which is closed not only by a rigid bottom wall 111, but also by vertical walls 112 that are preferably made of wood, but may also be made of metal or a plastic material—provided that the latter is odourless—and which rests on the floor through levelling feet 113 and/or casters (not shown). Said compartment 110 houses the whole refrigerating unit 50 that is described further on;

an intermediate compartment 120, which is constituted by two side walls 121 and a rear wall 122 made with panes of crystal glass, such as for instance the so called "thermopane" sheet-glass material that has a low heat-conductivity characteristics. Sealing of the joining seams between the glass panes is carried out by means of any of the known techniques, such as for instance through the use of a clear silicone sealant. The compartment 120 is closed frontally by a door 123, fabricated with a glass pane similar to the other ones, which occupies the whole of the front wall, is supported by means of preferably laminar hinges 124 by one of the side walls 121 and is provided with an appropriate handle (not shown). The bottom wall 125 of the intermediate compartment 120, which at the same time acts as the top wall of the lower compartment 110, is on the contrary made preferably of wood—but may also be made of metal or a plastic material, as far as the latter is odourless—and is sealed in the afore illustrated manner against the walls 121 and 122. The bottom wall 125 is provided with a central portion in form of a grating with a plurality of through-perforations 127 (see FIG. 2) and rows of evenly spaced through-slots 128, in an arrangement extending parallel to and in close proximity of the four sides of the compartment 120. In the bottom wall 125 there is furthermore provided a blind groove 129 (see FIG. 3) that extends all over the width thereof parallel to the rear wall 122 and is much closer to the latter than to the door 123 (see FIG. 2). The intermediate compartment 120 is adapted to store in a preferred manner bottled wine and/or other alcoholic beverages, but may be used also to store other food products, as far as these are odourless and/or contained in sealed containers. A rectangular and particularly thick pane of crystal glass 130 is arranged inside the intermediate compartment 120 in such a manner as to rest with its lower edge 134 in the groove 129 provided in the wall 125 (see FIG. 3) and, with its upper edge, in close vicinity of the top of the rear wall 122. The remaining two edges of the pane 130 can be either be close to the corresponding cabinet side walls 121—as shown in FIG. 1—or slightly spaced therefrom, if this is needed to improve the air flow in the intermediate compartment 120, as explained in the following. The inner volume of the intermediate compartment 120 is thus subdivided into two parts, generally indicated at A and B in FIG. 2, the former being significantly larger than the latter (for instance, 90% and 10% of the total volume of the compartment 120, respectively). In the pane 130 there are provided, in an appropriate geometrical arrangement, a plurality of cylindrical through-perforations 131, the terminal ends 132, 133 of which are radiused, ie. rounded and flared (see FIG. 4). The thickness of the glass pane 130, the shape and the size of the perforations 131 are selected in such a manner as to enable the neck portions of the bottles B1, B2 (of any type whatsoever among those available on the market) to be inserted through the perforations themselves so that the layout of the bottles may be either perpendicular to the pane 130 (so as to keep their cork properly wet) or horizontal (such as for instance in the case of bottles with crown caps or screw-type plug) according to the particular kind of neck and the latter being inserted in the corresponding perforation 131 to a lesser or greater extent (see FIG. 2);

an upper compartment 140 which is entirely made of wood, preferably an aromatic wood, and which comprises a bottom wall 141 that also forms the top wall of the intermediate compartment 120 and is similar to the afore described bottom wall 125, ie. featuring a central portion in the form of a grating with a plurality of through-perforations 143 (see FIG. 2) and rows of through-slots 144, in an arrangement extending parallel to and in close proximity of the four sides of the compartment. In a preferred embodiment of the invention, the said wall 141 is provided with a slot (not shown) where the upper edge of the glass pane 130 is accomodated with a small clearance. The sealing of the various walls of the compartment 140 both against each other and against the glass walls of the intermediate compartment 120 is carried out in the same manner as told earlier in this description. As this is best illustrated in FIG. 1, the side walls 145 are solid and closed, whereas access to the interior of the upper compartment 140 is ensured by two lids at right angle that are fixed in mutually opposite positions to the top wall 148 by means of hinges 149. In the proximity of the bottom wall 141, however at a certain vertical distance therefrom, inside the compartment 140 there is arranged a partition panel 150, which is also made of the same kind of wood as used for the compartment itself, and which has substantially the same overall size as the said wall 141. The surface of the panel 150 is almost entirely occupied by through-apertures 151 and is adapted to sustain cigars S1, S2, and/or other tobacco-based products, resting thereon, as this is best illustrated in FIG. 2. The upper compartment 140 is preferably fitted out with a hygrometer and, possibly, also a thermometer (not shown) in order to enable the users to keep the conditions of the air inside said compartment under close control.

From the functional point of view, the apparatus according to the present invention is characterized in that it makes preferably use of a thermoelectric refrigerating unit, for instance of the type sold in Italy under the trade-name of "ECOLD", which is generally indicated at 50 in FIG. 2. This unit (further to a temperature control device that may advantageously consist of an electronic thermostat of an already known type) substantially consists of an outer casing 51 mounted in an accommodation hole 115 provided in a closed wall 114 of a thermally and electrically insulating material, which occupies the entire plan-view extension of the lower compartment 110 of the apparatus.

Inside the outer casing 51 there is to be found a sandwich-type arrangement that is above all formed by a plurality of Peltier cells that are connected thermally in parallel and electrically in series with each other thanks to the connection via a pair of electric cables 53, 54 to a power supply 55 (per se well known) where the AC supplied by the power mains via a cable-and-plug assembly 56 is converted into a 12 or 24-V DC. Said sandwich arrangement is further formed by a pair of very thin horizontal ceramic plates, which are in turn associated to an upper heat sink 56, having a first motor-fan 57 associated therewith, and to a lower heat sink 58, having a second motor-fan associated therewith, respectively. The upper heat sink 56 is the low-temperature one, whereas the lower heat sink 58 is the high-temperature one.

The delivery side of the first motor-fan 57, which is situated in a central position under the bottom wall 125 of the intermediate compartment 120, is connected to the perforations of the grating-like portion 126 thereof via a frusto-conical conduit 60, while the intake side thereof is situated further down below, ie. in a lower position in correspondence of the upper heat sink 56, and receives the air flowing in from the peripheral slots 128, as this will be described in greater detail further on.

Again, the second motor-fan 59 is situated in a central position in correspondence of the lower heat sink 58. The solid, ie. closed wall 114 is effective in preventing the air flows generated by each one of the motor-fans 57 and 59 from mingling with each other.

Figure 5:
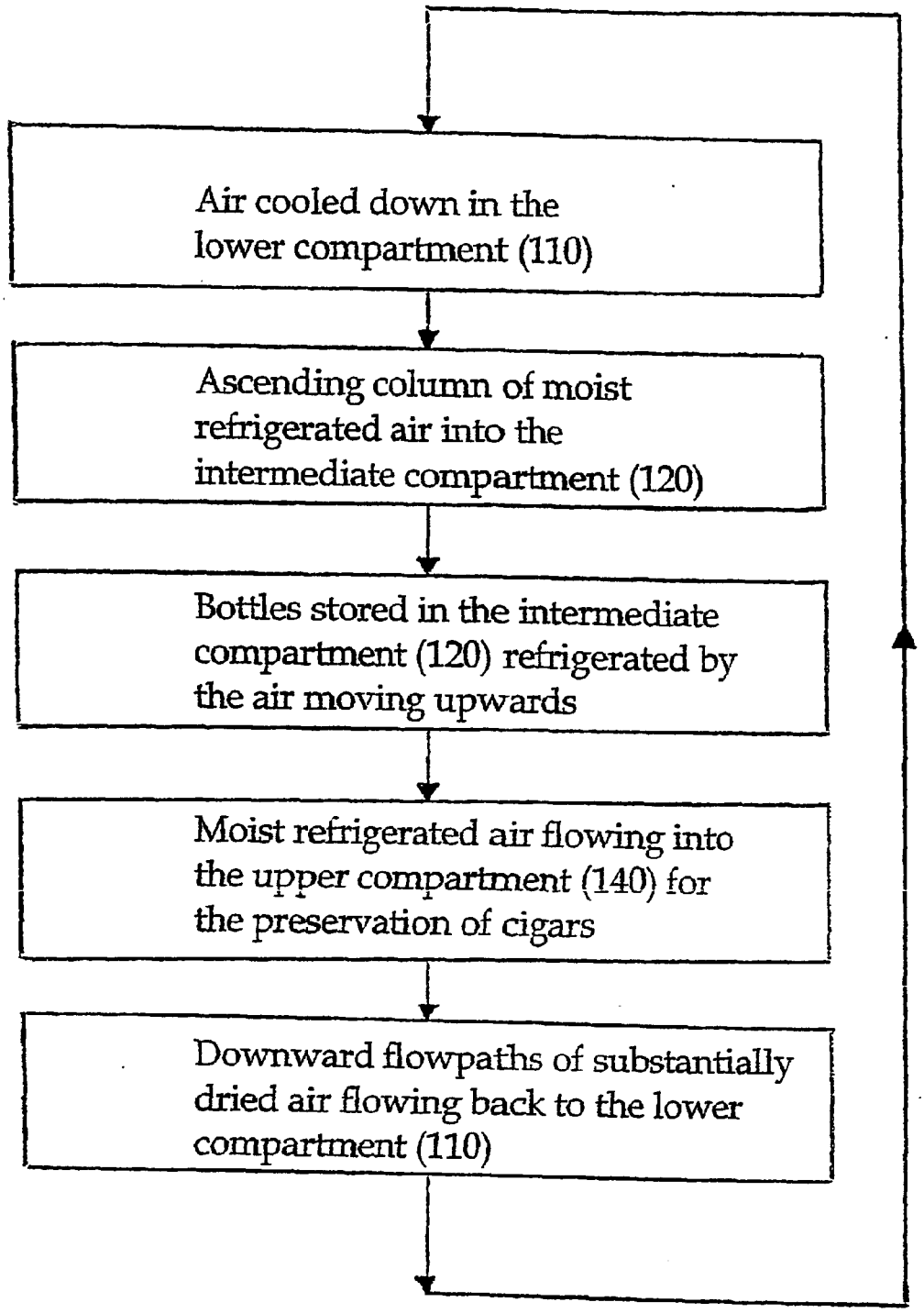
FIG. 5 is a block diagram of the method according to the present invention.

The method according to the present invention, as carried out in an apparatus made in accordance with the above description and installed in a room that typically has an ambient temperature of $T_A$=+20° C. or higher, comprises the following phases, which are repeated indefinitely, as illustrated in the block diagram of FIG. 5:

I) Within the upper zone of the lower compartment 110, the air taken in by the first motor-fan 57 is cooled down by the action of the upper heat sink 56 to a temperature $T_{MIN}$ in the order of +5/+10° C., ie. certainly and anyway higher than 0° C. but, of course, suitably lower than the ambient temperature $T_A$.

II) A forced flow of refrigerated air is generated from bottom upwards through the perforations 127 of the grating-like portion 126 of the bottom wall 125, in such a manner as to bring about an ascending column of refrigerated air inside the intermediate compartment 120, at the centre of the base of the apparatus. As this is indicated in FIG. 2 by the arrows F1 pointing upwards, such an ascending column is situated mostly, though not uniquely, before the pane 130, that is inside the frontal and larger part A of the inner volume of the compartment 120, which is also the part that accommodates the body of the bottles B1, B2.

III) The bottles B1, B2 (and/or any other food products possibly stored in the intermediate compartment 120) are evenly cooled down by said ascending column of refrigerated air. The temperature of the air will of course rise by a few degrees Celsius as it moves upwards along the ascending column, until it eventually reaches a value $T_{MAX}$ when it reaches the through-perforations 143 in the grating-shaped central portion 142 of the top wall 141 of the intermediate compartment 120 and the upper edge of the pane 130;

IV) The air is then circulated inside the upper compartment 140, ie. below and above the perforated panel 150 on which the cigars S1, S2 are resting, so as indicated by the horizontal arrows F2 of FIG. 2. It will of course be appreciated that the air inside the compartment 140 has also a relative humidity that, when the various design parameters of the apparatus (such as for instance the refrigeration capacity of the refrigerating unit 50, the flow rate ensured by the first motor-fan 57 and the load capability of the compartment 120) are appropriately defined, lies within an optimum range of values in view of the desired preservation of the cigars S and/or the other tobacco-based products that may be stored in this compartment. In any case, it will be possible to place a shallow tray (not shown) filled with water to increase the value of relative humidity;

V) The now substantially dried air flows back into the intermediate compartment 120, moving downwards under the suction of the first motor-fan 57 along four flow paths (in countercurrent with respect to the afore mentioned ascending column) which start from the through-slots 142 in the wall 141, move down along the side walls 121, the rear wall 122 and the door 123, flow through the slots 128 provided in the wall 125, and finally reach the upper heat sink 56 (see arrows F3 in FIG. 2). This is effective in preventing condensation from forming on the various glass surfaces, since the resulting misting effect would be of hindrance to a clear view by the users, through said glass surfaces, of the products stored in the compartment 120.

In a fully traditional manner, the lower heat sink 58 is cooled down by a flow of air which is taken in from the surrounding ambient, for example via through-slots 115 that are provided in at least one of the side walls 112 of the lower compartment 110 (see FIG. 1), and which is then conveyed back into the surrounding ambient by the second motor-fan 59 via apertures (not shown) provided in the bottom wall 111, as this is indicated by the arrows F4 and F5 in FIG. 2.

The advantages afforded to the consumers by the present invention are manifold and may be summarized as follows.

First of all, it provides a method and an apparatus that were not available to private users hitherto.

From a functional point of view, the use of a thermoelectric refrigerating unit ensures the largest possible extent of accuracy in controlling the values of both the temperature and relative humidity of the air used to refrigerate the beverages and to preserve the tobacco-based products. Furthermore, it does not generate any noise and does not make use of any of the traditional, aesthetically unpleasant evaporators.

From a construction point of view, the preferred use of a material such as wood for the compartment intended for storing the tobacco-based products, contributes to the scent of the same products being able to be kept unaltered throughout longer periods of time, whereas the use of crystal glass panes for almost the totality of the parts of the compartment intended for storing the beverages improves the overall fitness for use of the same compartment, further to conferring an excellent aesthetical appearance to the apparatus itself.

It will be appreciated that the apparatus according to the present invention—as claimed here below—may also be implemented in different embodiments and (as far as only the first and second compartments thereof are concerned) using materials differing from the above described ones, without of course departing from the scope of the appended claims. In particular, through an appropriate design of the perforations in the inclined glass pane, the apparatus may be adapted to also accommodate beverages packeed in other containers, eg. cans.

The alternative use of more traditional or widespread refrigerating units, such as compression or absorption ones, can finally not be excluded, even if this may put some penalty on the above described advantages.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Method for preserving at the same time tobacco-based products and bottled or packed beverages separately stored in a refrigerating apparatus, comprising:

a refrigeration phase to cool down air at a temperature above 0° C. in a first compartment situated below the compartment in which the beverages are separately stored from the tobacco-based products, generating a forced flow of refrigerated and moist air along an ascending column, utilizing of said ascending air column to refrigerate the beverages stored in a second compartment, creating of a plurality of flows of substantially dried air around said ascending column, and in countercurrent with respect thereto, along walls of said second compartment down to the said first compartment, the said ascending air column being used to create a circulation of air at controlled conditions of temperature and relative-humidity through a third compartment, in which there are stored the tobacco-based products, and which is above said second compartment and in communication therewith.

2. An apparatus for preserving tobacco-based products and bottled or packaged beverages comprising in a single cabinet a first compartment accommodating an entire refrigerating unit, and a second compartment wherein at least one of bottled beverages, packed beverages and other fresh food products can be accommodated, the second compartment being separated from said first compartment by a first wall comprising a central portion provided with a plurality of through-perforations and, along a periphery thereof, with through-slots, the apparatus also includes a third and uppermost compartment to accommodate at least one of cigars and other tobacco-based products, the third compartment being separated from said second compartment by a second wall also comprising a central portion provided with a plurality of through-perforations and, along its periphery, with through-slots.

3. The apparatus according to claim 2, wherein the refrigerating unit has a casing that encloses a sandwich arrangement comprising a plurality of Peltier cells, an upper heat sink with a first motor-fan associated therewith, and a lower heat sink with a second motor-fan associated therewith.

4. The apparatus according to claim 3, wherein a delivery side of the first motor-fan is connected with the central perforated portion of the partition wall between the first compartment and the second compartment via a connection conduit, whereas the intake side thereof is situated in correspondence of the upper heat sink and is adapted to receive the descending air flows entering through the peripheral slots provided in the same wall.

5. The apparatus according to claim 3 or 4, wherein the second motor-fan, associated with said lower heat sink, moves air that is taken in from and conveyed back to the outside ambient environment.

6. The apparatus according to claim 2, wherein the second compartment has side walls, a rear wall, and a full-height front door which are made with panels of clear, see-through material.

7. The apparatus of claim 6, wherein the see-through material is thermopane.

8. The apparatus according to claim 2, wherein a panel made of a see-through material is arranged inside said second compartment so as to be given an inclined posture closer to the rear wall than to the door, and is provided with a plurality of through-perforations that are adapted to accommodate at least one of necks of bottles and cans in which beverages are packed.

9. The apparatus of claim 8, wherein the see-through material is a pane of crystal glass.

10. The apparatus according to claim 8, wherein the through-perforations of the inclined panel have radiused and flared ends so as to enable the bottles to take a desired layout.

11. The apparatus according to claims 8 or 10, wherein said inclined panel rests with the lower edge thereof in a groove provided in the wall separating the first compartment from the second compartment, and is so arranged as to subdivide said second compartment into a first part facing the door and a second part facing the rear wall thereof, the said first part being much larger than the said second part.

12. The apparatus according to claim 2, wherein said third compartment is entirely made of wood including the wall separating it from the second compartment therebelow, as well as a partition panel for supporting tobacco-based products, which is parallel to said partition wall and provided with a plurality of through-apertures.

13. The apparatus according to claim 12, wherein the wood is aromatic wood.

* * * * *